US007237650B2

(12) United States Patent
Casebolt

(10) Patent No.: US 7,237,650 B2
(45) Date of Patent: Jul. 3, 2007

(54) TENSION DEVICE FOR USE WITH A SELF-RETRACTING LIFELINE

(75) Inventor: Scott C. Casebolt, St. Paul Park, MN (US)

(73) Assignee: D B Industries, Inc., Red Wing, MN (US)

( * ) Notice: Subject to any disclaimer, the term of this patent is extended or adjusted under 35 U.S.C. 154(b) by 625 days.

(21) Appl. No.: 10/848,905

(22) Filed: May 19, 2004

(65) Prior Publication Data

US 2005/0269153 A1 Dec. 8, 2005

(51) Int. Cl.
*A62B 1/08* (2006.01)
*B65H 59/16* (2006.01)

(52) U.S. Cl. ..... 182/231; 188/65.2

(58) Field of Classification Search ..... 182/231, 182/232, 234, 235, 236, 3, 36, 5, 73, 70; 188/266, 65.2–65.4; 254/377, 381–391, 254/405

See application file for complete search history.

(56) References Cited

U.S. PATENT DOCUMENTS 2,796,953 A * 6/1957 Becker ..... 188/65.1
4,538,702 A 9/1985 Wolner
4,618,026 A * 10/1986 Olson ..... 182/4
4,877,110 A 10/1989 Wolner
4,938,435 A * 7/1990 Varner et al. ..... 182/231
5,060,758 A * 10/1991 Ishioka ..... 182/234
5,090,503 A * 2/1992 Bell ..... 182/5
5,174,410 A 12/1992 Casebolt
5,186,289 A 2/1993 Wolner et al.
5,287,943 A * 2/1994 Bell ..... 182/3
5,316,102 A * 5/1994 Bell ..... 182/3
5,361,866 A * 11/1994 Bell et al. ..... 182/3
6,279,682 B1 * 8/2001 Feathers ..... 182/239
6,467,573 B1 * 10/2002 Parker ..... 182/3
6,581,725 B2 * 6/2003 Choate ..... 182/3
6,810,997 B2 * 11/2004 Schreiber et al. ..... 182/238
6,990,928 B2 * 1/2006 Kurtgis ..... 182/36

* cited by examiner

*Primary Examiner*—Hugh B. Thompson, II
(74) *Attorney, Agent, or Firm*—IPLM Group, P.A.

(57) ABSTRACT

A tension device for use with a self-retracting lifeline having a drum includes a lifeline and an elastic member. The lifeline has a retracting end, an intermediate portion, and a connecting end. The retracting end is operatively connected to the drum, and the connecting end is releasably connectable to a user. The elastic member interconnects the retracting end and the connecting end. The elastic member provides tension on the lifeline and prevents the drum from retracting the lifeline when the connecting end of the lifeline rebounds in an upward direction during a fall.

20 Claims, 5 Drawing Sheets

TENSION DEVICE FOR USE WITH A SELF-RETRACTING LIFELINE

BACKGROUND OF THE INVENTION

1. Field of the Invention

The present invention relates to a tension device for use with a self-retracting lifeline.

2. Description of the Prior Art

Self-retracting lifelines are well known in the art of fall protection safety equipment for use by users performing tasks during which there is a risk a fall may occur. Self-retracting lifelines generally include a housing containing a drum around which a lifeline made of cable, rope, or webbing is wound. The drum is spring biased to pay out the lifeline as tension pulling the lifeline is applied and to retract any of the lifeline that has been unwound from the drum as the tension on the lifeline is reduced or released. In other words, the lifeline is paid out as the user moves away from the housing and the lifeline is retracted as the user moves toward the housing. The housing also includes a brake assembly for stopping rotation of the drum when the lifeline suddenly unwinds from the drum at a rate greater than a predetermined maximum angular velocity.

A self-retracting lifeline is typically connected to a support structure within the vicinity the user is performing the task, and the connecting end of the lifeline is typically connected to a safety harness worn by the user. The lifeline is easily drawn out of the self-retracting lifeline housing as the user moves away from the device, and the lifeline is automatically drawn back into the housing as the user moves toward the device. Should a fall occur, the brake assembly within the device is automatically engaged by a centrifugal clutch assembly, which stops the user's fall by gradually and quickly stopping the rotation of the drum. As the rotation of the drum is stopped, additional lifeline is prevented from being paid out of the housing to arrest the fall of the user.

During the fall, a ratcheting effect may occur. The term "ratcheting" in this context is a term used in the art to describe when the weight on the connecting end of the locked lifeline rebounds upward upon impact. The upward rebound releases the brake assembly thereby allowing the lifeline to be retracted and paid out, and the user will fall further until the brake assembly again stops the rotation of the drum. This ratcheting effect may occur several times during a fall.

A shock absorber may be operatively connected proximate the connecting end of the lifeline to dissipate the force should a fall occur. Once the lifeline of the self-retracting lifeline is locked by the brake assembly, the shock absorber reduces the force of the fall on the user. A typical shock absorber utilizes a tearing action to absorb the force as the fall of the user is arrested. Although the shock absorber reduces the force of the fall, the ratcheting affect may still occur during a fall.

SUMMARY OF THE INVENTION

A preferred embodiment tension device for use with a self-retracting lifeline including a drum includes a lifeline and an elastic member. The lifeline has a retracting end, an intermediate portion, and a connecting end. The retracting end is operatively connected to the drum and the connecting end is releasably connectable to a user. The lifeline includes slack proximate the intermediate portion. The elastic member interconnects the retracting end and the connecting end. The elastic member provides tension on the lifeline and prevents the drum from retracting the lifeline when the connecting end of the lifeline rebounds in an upward direction during a fall.

A preferred embodiment self-retracting lifeline having a tension device includes a lifeline, a drum, a brake assembly, and an elastic member. The lifeline has a retracting end, an intermediate portion, and a connecting end. The connecting end is releasably connectable to a user. The lifeline includes slack proximate the intermediate portion. The retracting end of the lifeline is operatively connected to the drum and is wound about the drum. The drum is rotatable to pay out and retract the lifeline. The brake assembly engages the drum and prevents the drum from rotating during a fall thereby preventing the drum from paying out the lifeline. The elastic member interconnects the retracting end and the connecting end. The elastic member provides tension on the lifeline thereby preventing the brake assembly from releasing the drum and preventing the drum from retracting the lifeline when the connecting end of the lifeline rebounds in an upward direction during a fall.

A preferred embodiment tension device for use with a self-retracting lifeline including a drum includes a lifeline and means for providing tension on the lifeline. The lifeline has a retracting end, an intermediate portion, and a connecting end. The retracting end is operatively connected to the drum and the connecting end is releasably connectable to a user. The means for providing tension on the lifeline interconnects the retracting end and the connecting end and prevents the drum from retracting the lifeline when the connecting end of the lifeline rebounds in an upward direction during a fall.

A preferred embodiment tension device for use with a self-retracting lifeline including a drum includes a lifeline, an elastic member, and a shock absorber. The lifeline has a retracting end, an intermediate portion, and a connecting end. The retracting end is operatively connected to the drum and the connecting end is releasably connectable to a user. The lifeline includes slack proximate the intermediate portion. The elastic member interconnects the retracting end and the connecting end. The shock absorber interconnects the retracting end and the connecting end proximate the intermediate portion and the elastic member. The shock absorber includes a first portion and a second portion. The first portion and the second portion separate to absorb shock as the slack in the lifeline is reduced during a fall, and the elastic member provides tension on the lifeline and prevents the drum from retracting the lifeline when the connecting end of the lifeline rebounds in an upward direction during a fall.

DETAILED DESCRIPTION OF A PREFERRED EMBODIMENT

Figure 1:
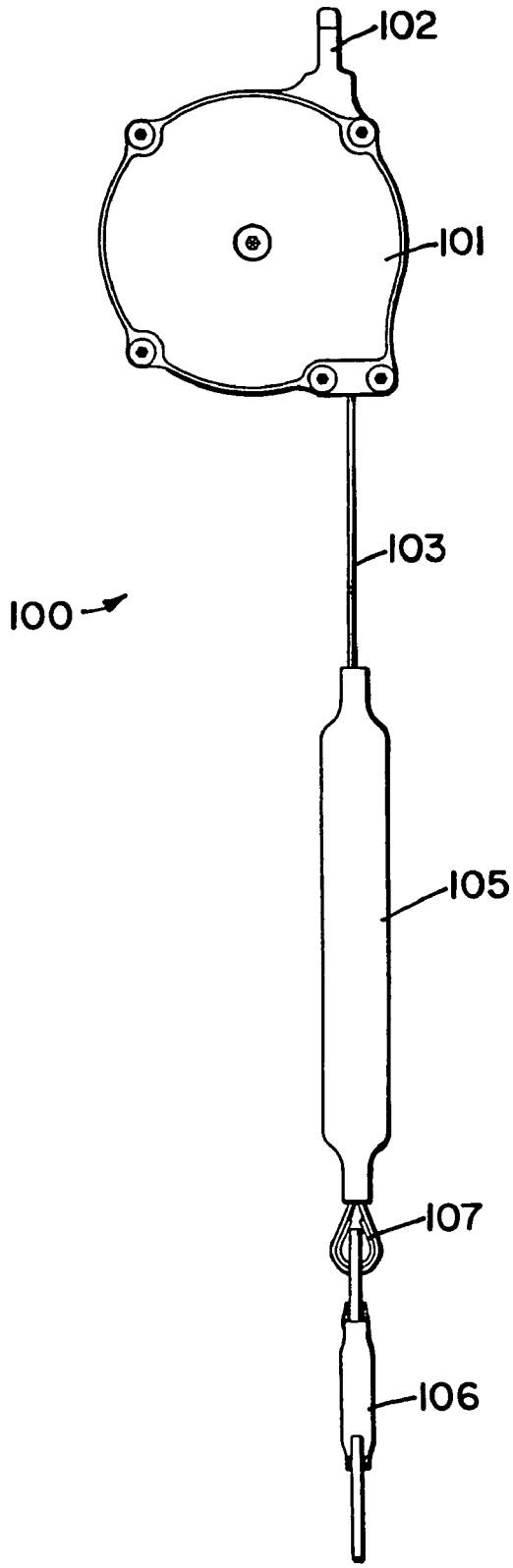
FIG. 1 is a side view of a tension device constructed according to the principles of the present invention operatively connected to a self-retracting lifeline.

A preferred embodiment tension device for use with a self-retracting lifeline constructed according to the principles of the present invention is designated by the numerals 110 and 110' in the drawings.

As shown in FIG. 1, a self-retracting lifeline 100 includes a housing 101 having a connecting member 102 through which a connector (not shown) such as a hook may be used to connect the housing 101 to a support structure. The housing 101 is configured and arranged to contain a drum (not shown) around which a lifeline 103 is wound. The drum is spring biased to pay out the lifeline 103 as tension pulling the lifeline 103 is applied and to retract any of the lifeline 103 that has been unwound from the drum as the tension on the lifeline 103 is reduced or released. The housing 101 also includes a brake assembly (not shown) for stopping rotation of the drum when the lifeline 103 suddenly unwinds from the drum at a rate greater than a predetermined maximum angular velocity. Preferably, a sleeve 105 contains either the tension device 110 or the tension device 110' proximate the connecting end of the lifeline 103. The sleeve 105 also acts as a stop to prevent the lifeline 103 from being completely retracted into the housing 101. A hook 106 is operatively connected to the connecting end of the lifeline 103, and the hook 106 is configured and arranged to connect to a safety harness donned by a user.

Figure 4:
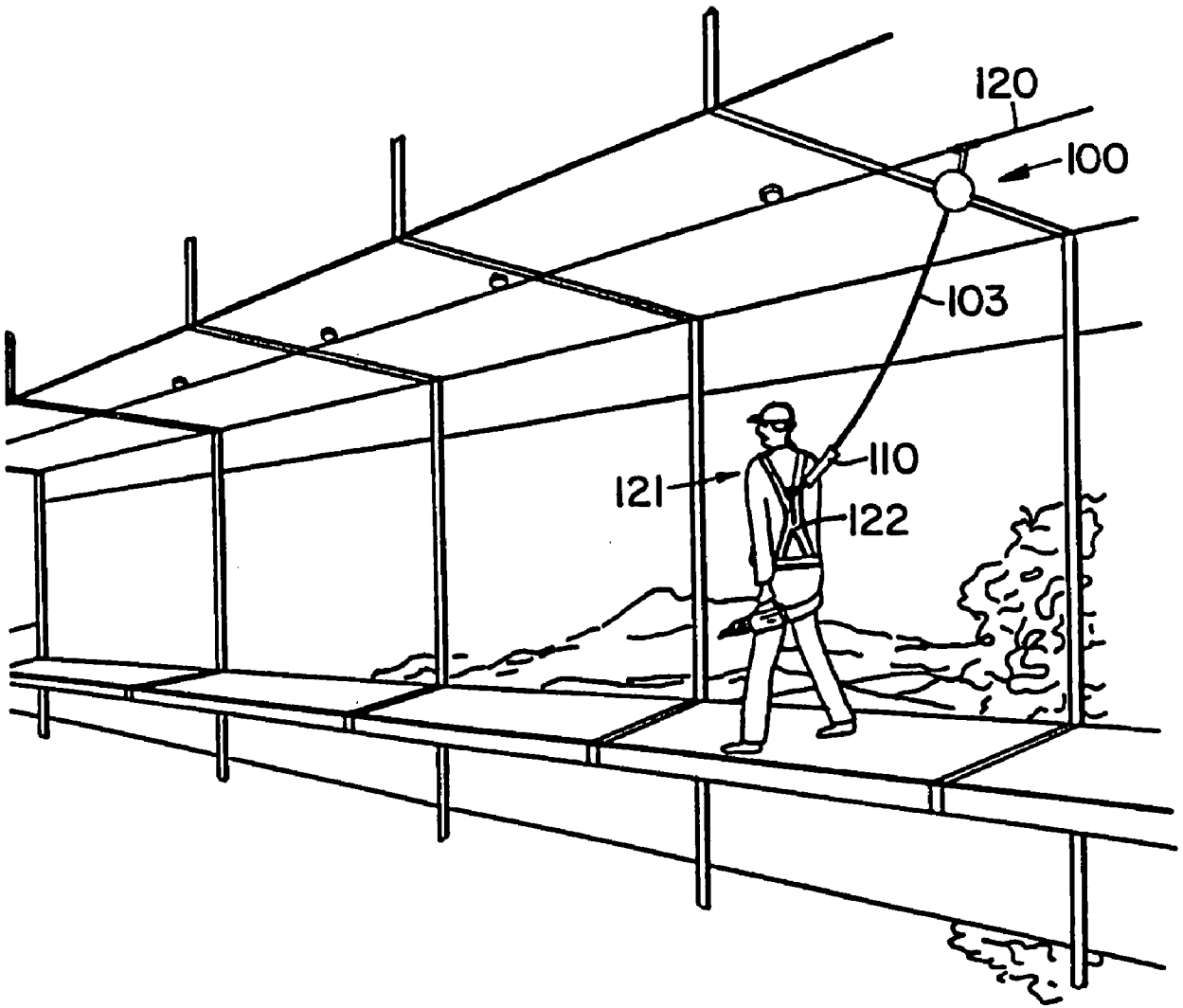
FIG. 4 is a perspective view of the tension device shown in FIG. 1 in use.

Although it is recognized that any suitable self-retracting lifeline known in the art may be used with the present invention, examples of possible self-retracting lifelines that may be used with the present invention are disclosed in U.S. Pat. Nos. 4,877,110 and 5,186,289, which are incorporated by reference herein. As shown in FIG. 4, the self-retracting lifeline 100 interconnects a support structure 120 such as a horizontal lifeline and a user 121 donning a harness 122. The lifeline 103 is connected to the harness 122, and the tension device 110 is operatively connected to the lifeline 103 proximate the user 121. The lifeline 103 includes a connecting end 103*a*, an intermediate portion 103*b*, and a retracting end 103*c*. A hook 106 is operatively connected to the connecting end 103*a* and is releasably connectable to a user. The end of the connecting end 103*a* is preferably inserted through an opening in the hook 106 and secured to the portion of the connecting end 103*a* on the opposite side of the hook 106, preferably by stitching. A wear pad 107, which is preferably a piece of webbing, may be used. The wear pad 107 protects the lifeline 103 against wear from rubbing on the hook 106. The retracting end 103*c* is operatively connected to the drum of the self-retracting lifeline 100.

Figure 2:
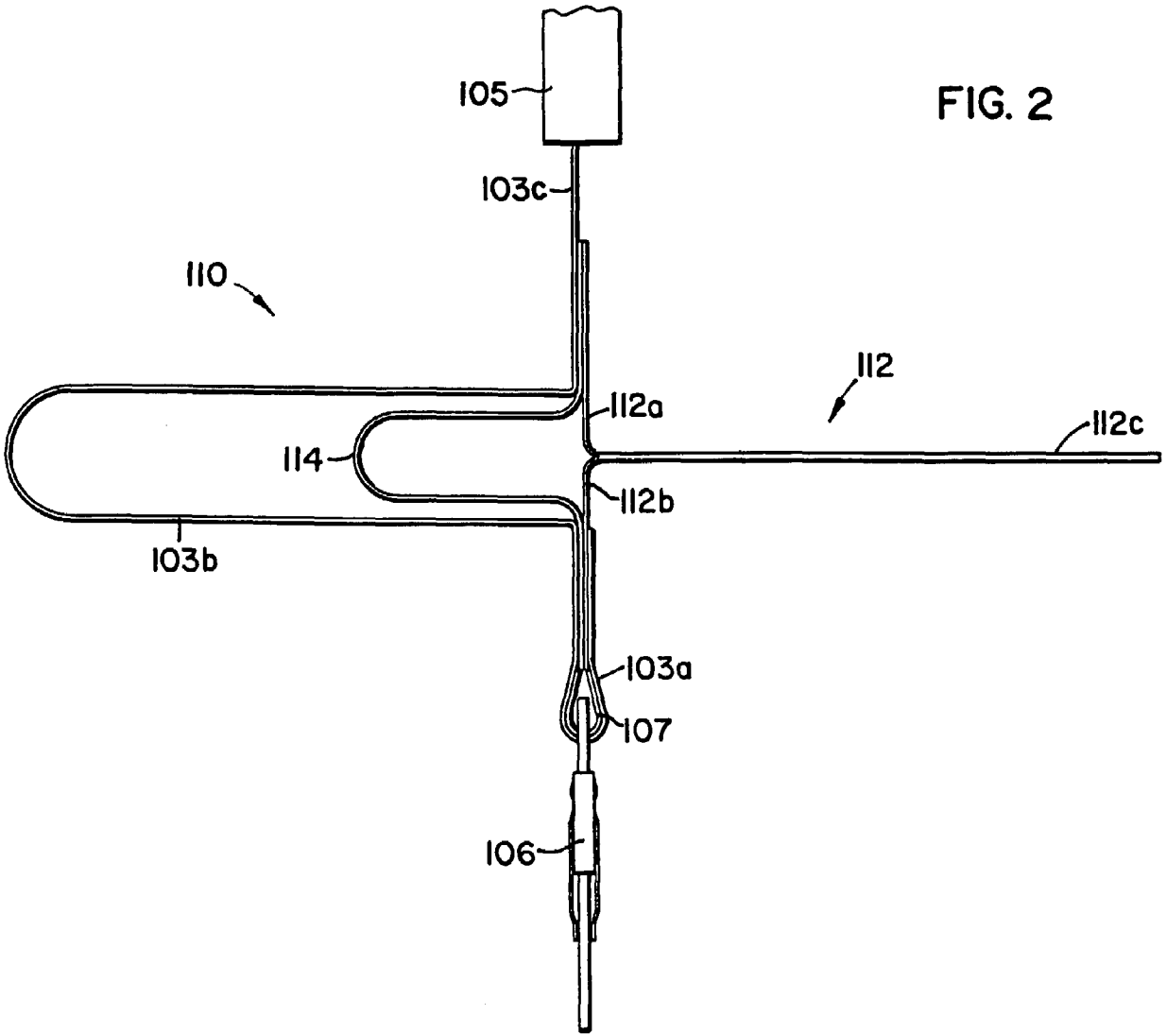
FIG. 2 is a side view of the components of an embodiment of the tension device shown in FIG. 1.
Figure 3:
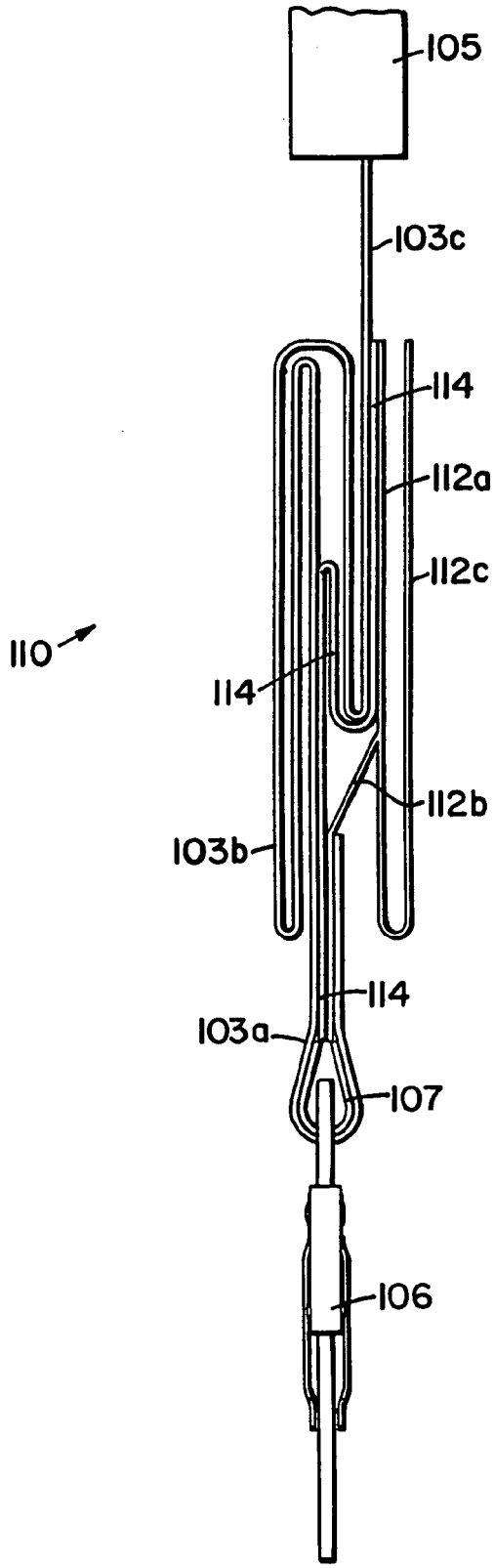
FIG. 3 is a side view of the components of the tension device shown in FIG. 2 arranged to fit within a sleeve.

In one embodiment, the tension device 110 includes an elastic member 114 that interconnects the connecting end 103*a* and the retracting end 103*c*, as shown in FIGS. 2 and 3. One end of the elastic member 114 is connected to the retracting end 103*c*, preferably by stitching, and the other end is connected to the connecting end 103*a*, also preferably by stitching. The elastic member 114 is shorter in length than the intermediate portion 103*b*. The elastic member 114 is preferably made of a piece of elongate elasticized material such as elastic or rubber. The elastic member 114 could also be a spring or a resilient cord, and the elastic member 114 is preferably capable of stretching approximately 170% to 190%+/−20%. It is recognized that any suitable material known in the art may be used, and the elastic member 114 may be made of one or more layers of material.

The tension device 110 also includes an optional shock absorber 112, which includes a first portion 112*a* and a second portion 112*b*. One end of the first portion 112*a* is connected to the retracting end 103*c* proximate the intermediate portion 103*b*, preferably by stitching, and one end of the second portion 112*b* is connected to the connecting end 103*a* proximate the intermediate portion 103*b*, also preferably by stitching. The end of the elastic member 114 and the end of the second portion 112*b* are preferably secured to the connecting end 103*a* between the layers of the connecting end 103*a* preferably sewn together to secure the hook 106 thereto. The other ends of the first portion 112*a* and the second portion 112*b* are preferably interwoven or sewn together with stitching thereby forming an interconnected portion 112*c* proximate the intermediate portion 103*b* of the lifeline 103. Preferably, the interwoven fibers or the stitching of the interconnected portion 112*c* are torn thereby separating the first portion 112*a* and the second portion 112*b* when subjected to a fall, which reduces the arresting forces of the fall. The shock absorber 112 preferably helps keep the fall arresting forces under 900 pounds.

The lifeline 103 includes slack proximate the intermediate portion 103*b*. When the interconnected portion 112*c* of the shock absorber 112 is intact, the slack in the lifeline 103 is created by the shock absorber 112. Because the interconnection of the connecting end 103*a* and the retracting end 103*c* by the shock absorber 112 is shorter in length than the elastic member 114 and the intermediate portion 103*b*, the slack is created in the elastic member 114 and in the lifeline 103 proximate the intermediate portion 103*b*. Preferably, the combined length of the portions 112*a* and 112*b* after separation of the interconnected portion 112*c* into portions 112*a* and 112*b* is approximately equal to the length of the intermediate portion 103*b* and the length of the fully stretched elastic member 114.

After the shock absorber 112 has separated during a fall, the elastic member 114 provides tension in the lifeline 103 proximate the intermediate portion 103*b*. The slack, which is reduced, is then created by the elastic member 114. Even though the amount of slack may vary as the elastic member 114 stretches and contracts, the elastic member provides tension on the lifeline 103 even though there is also varying slack in the lifeline 103. The elastic member 114 preferably has enough retraction tension over great enough distance to prevent the drum from retracting the lifeline 103. In other words, the elastic member 114 keeps tension in the lifeline 103, and this tension force is greater than the retraction force so that the elastic member 114 pulls downward on the lifeline 103 more than the force upon impact pulls upward on the lifeline 103 proximate the connecting end 103*a* so that the retracting end 103*c* will not retract into the housing 101 of the self-retracting lifeline 100 upon impact to unlock the lifeline 103. This tension on the lifeline 103 prevents the ratcheting effect from occurring. The elastic member 114 has an elasticity such that the tension on the lifeline 103, a downward force on the retracting end 103*c*, is greater than an upward force on the elastic member 114 from the rebounding connecting end 103*a* during a fall.

Preferably, the interconnected portion 112*c* extends from one side of the lifeline 103, and the elastic member 114 and the intermediate portion 103*b* extend from the other side of the lifeline 103, the elastic member 114 preferably inside the intermediate portion 103*b*, as shown in FIG. 2. As shown in FIG. 3, the tension device 110 may be folded so that it can be contained in a sleeve 105, which is preferably made of shrink tubing. The sleeve 105 may then be slid in place about the folded tension device 110. Once the sleeve 105 is placed about the tension device 110, the ends of the sleeve 105 are shrunk to envelope and contain the tension device 110.

Figure 5:
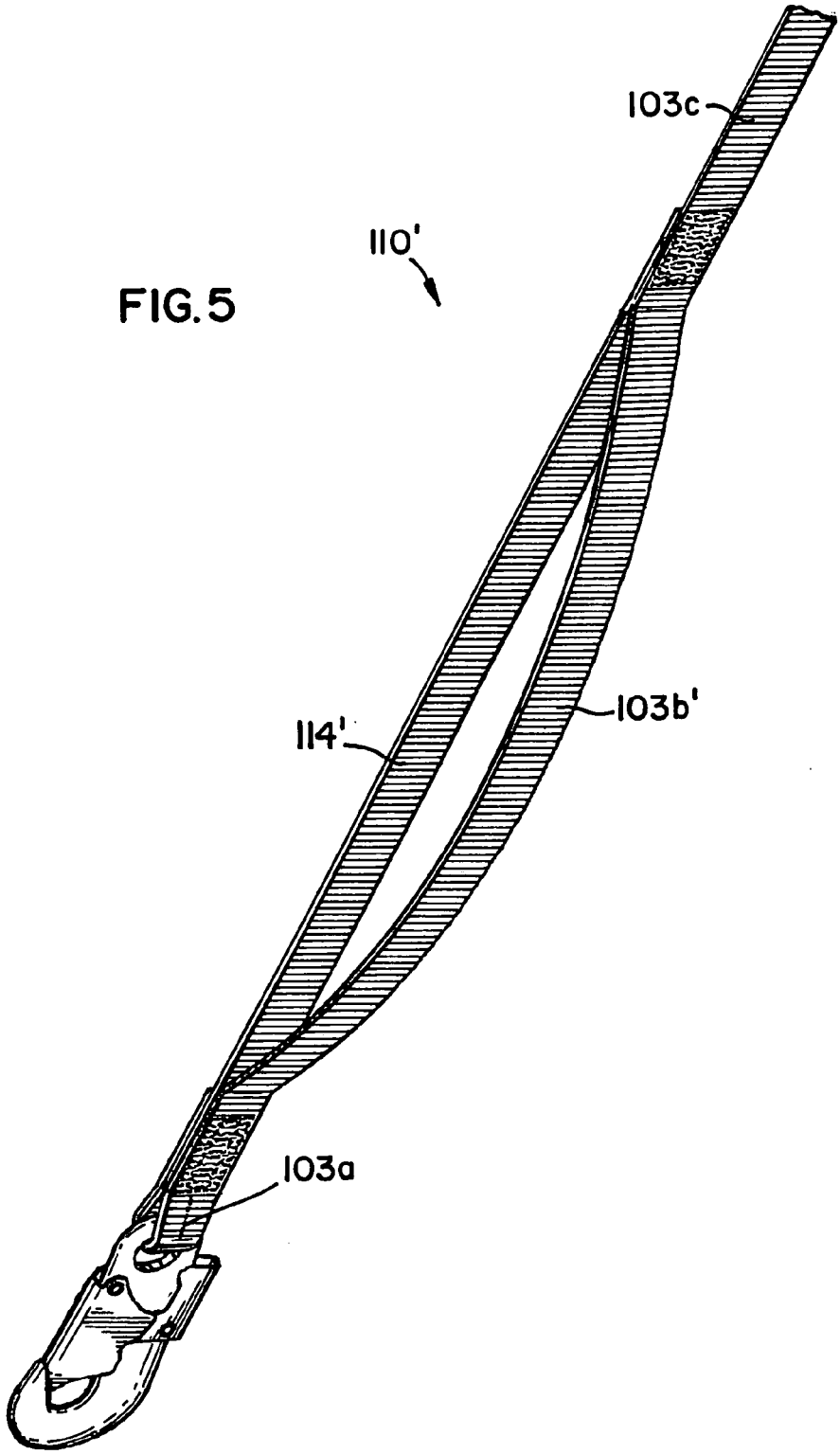
FIG. 5 is a side view of the components of another embodiment of the tension device shown in FIG. 1.

In another embodiment, as shown in FIG. 5, the tension device 110' includes an elastic member 114'. The tension device 110' is similar to the tension device 110 but does not include a shock absorber. Both tension devices 110 and 110' are configured and arranged to fit within the sleeve 105 as shown in FIG. 1. One end of the elastic member 114' is connected to the retracting end 103*c*, preferably by stitching, and the other end is connected to the connecting end 103*a*, also preferably by stitching. Because the elastic member 114' is shorter in length than the intermediate portion 103*b*', slack is created in the lifeline 103 proximate the intermediate portion 103*b*' by the elastic member 114'. As the elastic member 114' is stretched and extended, the slack in the lifeline 103 is reduced, and as the elastic contracts and shortens to resume its unextended length, the slack in the lifeline 103 is increased.

Even though the amount of slack may vary as the elastic member 114' stretches and contracts, the elastic member 114' provides tension on the lifeline 103 even though there is also varying slack in the lifeline 103. The elastic member 114' preferably has enough retraction tension over great enough distance to prevent the drum from retracting the lifeline 103. In other words, the elastic member 114' keeps tension in the lifeline 103, and this tension force is greater than the retraction force so that the elastic member 114' pulls downward on the lifeline 103 more than the force upon impact pulls upward on the lifeline 103 proximate the connecting end 103*a* so that the retracting end 103*c* will not retract into the housing 101 of the self-retracting lifeline 100 upon impact to unlock the lifeline 103. This tension on the lifeline 103 prevents the ratcheting effect from occurring. The elastic member 114' has an elasticity such that the tension on the lifeline 103, a downward force on the retracting end 103*c*, is greater than an upward force on the elastic member 114' from the rebounding connecting end 103*a* during a fall.

In operation, when a fall occurs, the brake assembly engages the drum and prevents the drum from rotating during the fall thereby preventing the drum from paying out the lifeline 103. The sleeve 105 remains in place and covers/protects the tension device 110 or 110'. The sleeve 105 does not interfere with the operation of the tension device 110 or 110' or restrict the extension of the lifeline 103 resulting from a fall. If the tension device 110 including the shock absorber 112 is used, the interconnected portion 112*c* of the shock absorber 112 begins to separate and absorb some of the shock from the fall. The interconnected portion 112*c* is separated into the first portion 112*a* and the second portion 112*b* as the slack in the elastic member 114 and some of the slack in the lifeline 103 proximate the intermediate portion 103*b* are reduced. After the interconnected portion 112*c* of the shock absorber 112 has separated, the elastic member 114 keeps tension on the lifeline 103 when any slack proximate the intermediate portion 103*b* of the lifeline 103 develops. The elastic member 114 of the tension device 110 provides tension on the lifeline 103 and prevents the brake assembly from releasing the drum, which prevents the drum from retracting the lifeline 103 when the connecting end of the lifeline 103 rebounds in an upward direction during the fall.

If the tension device 110' is used, the elastic member 114' keeps tension on the lifeline 103 when any slack proximate the intermediate portion 103*b*' of the lifeline 103 develops. The elastic member 114' of the tension device 110' provides tension on the lifeline 103 and prevents the brake assembly from releasing the drum, which prevents the drum from retracting the lifeline 103 when the connecting end of the lifeline 103 rebounds in an upward direction during the fall.

Although some lifelines may have some degree of elasticity and this elasticity may prevent some degree of ratcheting effect from occurring, this device will significantly reduce the slack that may otherwise develop in the lifeline resulting from rebounds should a fall occur.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A tension device for use with a self-retracting lifeline including a drum, comprising:

a) a lifeline having a retracting end, an intermediate portion, and a connecting end, the retracting end adapted to be operatively connected to the drum, the connecting end being operatively connected to a connector that is releasably connectable to a user, the lifeline including slack proximate the intermediate portion; and b) an elastic member interconnecting the retracting end and the connecting end, the elastic member providing tension on the lifeline and preventing the drum from retracting the lifeline when the connecting end of the lifeline rebounds in an upward direction during a fall.

2. The tension device of claim 1, further comprising a sleeve in which the intermediate portion and the elastic member are contained.

3. The tension device of claim 1, wherein the slack in the lifeline is created by the elastic member.

4. The tension device of claim 1, further comprising a shock absorber interconnecting the retracting end and the connecting end proximate the intermediate portion and the elastic member, wherein the slack in the lifeline is created by the shock absorber.

5. The tension device of claim 4, wherein the shock absorber includes a first portion and a second portion, the first portion and the second portion separating to absorb shock as the slack in the lifeline is reduced during a fall.

6. The tension device of claim 1, wherein the elastic member has an elasticity such that the tension on the lifeline is greater than an upward force on the elastic member from the rebounding connecting end during a fall.

7. A self-retracting lifeline having a tension device, comprising:

a) a lifeline having a retracting end, an intermediate portion, and a connecting end, the connecting end being operatively connected to a connector that is releasably connectable to a user, the lifeline including slack proximate the intermediate portion;

b) a drum, the retracting end of the lifeline being operatively connected to the drum and being wound about the drum, the drum being rotatable to pay out and retract the lifeline;

c) a brake assembly engaging the drum and preventing the drum from rotating during a fall thereby preventing the drum from paying out the lifeline; and d) an elastic member interconnecting the retracting end and the connecting end, the elastic member providing tension on the lifeline thereby preventing the brake assembly from releasing the drum and preventing the drum from retracting the lifeline when the connecting end of the lifeline rebounds in an upward direction during a fall.

8. The self-retracting lifeline of claim 7, wherein slack in the lifeline is created by the elastic member.

9. The self-retracting lifeline of claim 7, further comprising a shock absorber interconnecting the retracting end and the connecting end proximate the intermediate portion and the elastic member, wherein the slack in the lifeline is created by the shock absorber.

10. The self-retracting lifeline of claim 9, wherein the shock absorber includes a first portion and a second portion, the first portion and the second portion separating to absorb shock as the slack in the lifeline is reduced during a fall.

11. The self-retracting lifeline of claim 7, wherein the elastic member has an elasticity such that the tension on the lifeline is greater than an upward force on the elastic member from the rebounding connecting end during a fall.

12. A tension device for use with a self-retracting lifeline including a drum, comprising:

a) a lifeline having a retracting end, an intermediate portion, and a connecting end, the retracting end adapted to be operatively connected to the drum, the connecting end being operatively connected to a connector that is releasably connectable to a user; and b) means for providing tension on the lifeline interconnecting the retracting end and the connecting end and preventing the drum from retracting the lifeline when the connecting end of the lifeline rebounds in an upward direction during a fall.

13. The tension device of claim 12, wherein the lifeline includes slack proximate the intermediate portion created by the means for providing tension.

14. The tension device of claim 12, wherein the means for providing tension is an elastic member.

15. The tension device of claim 14, further comprising a shock absorber interconnecting the retracting end and the connecting end proximate the intermediate portion and the elastic member, wherein the lifeline includes slack proximate the intermediate portion created by the shock absorber.

16. The tension device of claim 15, wherein the shock absorber includes a first portion and a second portion, the first portion and the second portion separating to absorb shock as the slack in the lifeline is reduced during a fall.

17. A tension device for use with a self-retracting lifeline including a drum, comprising:

a) a lifeline having a retracting end, an intermediate portion, and a connecting end, the retracting end adapted to be operatively connected to the drum, the connecting end being operatively connected to a connector that is releasably connectable to a user, the lifeline including slack proximate the intermediate portion;

b) an elastic member interconnecting the retracting end and the connecting end; and c) a shock absorber interconnecting the retracting end and the connecting end proximate the intermediate portion and the elastic member, the shock absorber including a first portion and a second portion, the first portion and the second portion separating to absorb shock as the slack in the lifeline is reduced during a fall, and the elastic member providing tension on the lifeline and preventing the drum from retracting the lifeline when the connecting end of the lifeline rebounds in an upward direction during a fall.

18. The tension device of claim 17, wherein the slack in the lifeline is created by the shock absorber.

19. The tension device of claim 17, further comprising a sleeve in which the intermediate portion of the lifeline, the elastic member, and the shock absorber are contained.

20. The tension device of claim 17, wherein the elastic member has an elasticity such that the tension on the lifeline is greater than an upward force on the elastic member from the rebounding connecting end during a fall.

* * * * *